United States Patent [19]

Thrift et al.

[11] Patent Number: 5,050,751

[45] Date of Patent: Sep. 24, 1991

[54] RAILWAY FREIGHT CAR COMBINATION COUPLER KNUCKLE HANGER AND KNUCKLE PIN HOLDER

[76] Inventors: Jimmie R. Thrift, Rt. 3, P.O. Box 537, Waycross, Ga. 31501; Nass Hendley, 201 William St., Homerville, Ga. 31634

[21] Appl. No.: 508,121

[22] Filed: May 11, 1990

[51] Int. Cl.[5] ..... B61G 7/00

[52] U.S. Cl. ..... 213/111; 213/1 R; 213/155

[58] Field of Search ..... 213/1 R, 100 R, 111, 213/112, 118, 152, 155, 156

[56] References Cited

U.S. PATENT DOCUMENTS

| | | | |
|---|---|---|---|
| 824,912 | 7/1906 | Cross et al. | 213/111 |
| 983,412 | 2/1911 | Sullivan | 213/111 |
| 1,416,368 | 5/1922 | McCathy | 213/156 X |
| 4,627,545 | 12/1986 | Herbert et al. | 213/100 R |

*Primary Examiner*—Robert J. Oberleitner
*Assistant Examiner*—S. Joseph Morano
*Attorney, Agent, or Firm*—Arthur G. Yeager

[57] ABSTRACT

A combination knuckle hanger and knuckle pin holder tool for holding the knuckle and knuckle pin of a railway coupler, in which the knuckle and knuckle pin may be held in position from the coupler during internal repairs. The tool has a fork shaped base portion which is adapted to be inserted into the casting holes of a railway coupler in order to releasably secure the tool to the coupler. A holder cup is rigidly attached to the curved portion of the fork for holding the knuckle pin during the repairs, and an angled knuckle hanging peg is also attached to the curved portion of the fork for hanging the knuckle during repairs, thereby allowing the knuckle and knuckle pin to be conveniently stored on the coupler during the repair of the internal coupler parts.

19 Claims, 3 Drawing Sheets

RAILWAY FREIGHT CAR COMBINATION COUPLER KNUCKLE HANGER AND KNUCKLE PIN HOLDER

BACKGROUND

1. Field of the Invention

This invention relates to tools, used by the railroad industry, to repair freight car couplers.

2. Description of Prior Art

Railway freight cars are linked together by a device called a coupler, one on each end of freight cars. They are attached to the car by a heavy steel pin, called a cross key. Inside the coupler are several parts which have to be replaced when worn or broken. To gain access to these internal parts, the largest component, the knuckle, of the coupler must be removed. It is steel and weighs approximately eighty three pounds. To accomplish this, the freight cars are separated but coupler does not have to be removed from freight car. The knuckle pin is then removed, by hand, this part attaches the knuckle to the coupler, weighs seven pounds, and is fourteen inches long and one and five eighths inches in diameter. This frees knuckle from coupler, and now may be removed by hand.

The procedure now is to place knuckle and pin on the floor, where they become a tripping hazard, and a risk for back injuries when being lifted up! Some technicians are placing them on top of the coupler body. This also is unsafe because technician will have to lift knuckle above waist level. Also, injuries have been sustained from knuckle and knuckle pin falling off coupler body onto technicians repairing couplers. Another method is for technicians to place a table nearby and carry the knuckle and pin and place on it. This is both inconvenient and strenuous to technicians.

OBJECTS AND ADVANTAGES

Accordingly, we claim the following as our objects and advantages of the invention:

(a) provides a dual purpose tool for safer, faster and easier repair of a freight car coupler;

(b) we claim that this tool having no moving parts and being of sturdy construction will last indefinitely;

(c) provides the closest place, approximately fourteen inches, to put knuckle and knuckle pin when removed from coupler;

(d) in addition we claim this to be a tool light to handle, compact and easily stored;

The average height of a freight car coupler, on car, is approximately waist high to an average person. Therefore, technicians using our tool will not have to do any bending. Most railroads are very safety oriented. We know that our tool will help immensely to prevent injuries.

At this time we know of no method approaching our innovation. Therefore, we feel one demonstration of our tool will convince freight car technicians of the importance and effectiveness of using our tool. Further advantages of our tool will become apparent after studying the ensuing description and drawings.

DRAWING FIGURES

REFERENCE NUMERALS IN DRAWINGS

Figure 1:
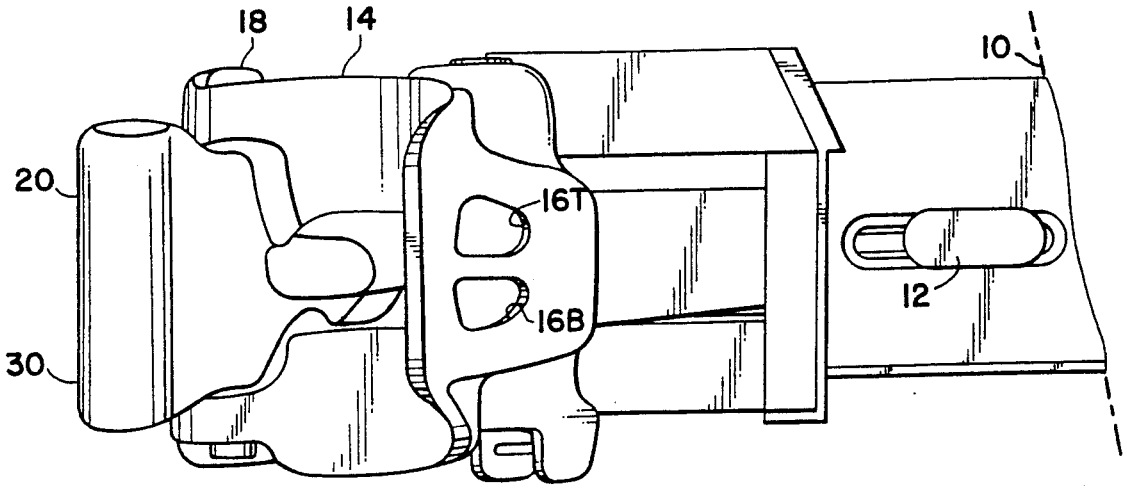
FIG. 1 shows view our invention relates to the railway freight car coupler attached to the freight car.

10 end of freight car
12 cross key
14 coupler
16T coupler body casting hole
16B coupler body casting hole
18 coupler knuckle pin
20 coupler knuckle
21 coupler knuckle pin hole
22 combination tool knuckle hanging peg
24 combination tool support fork
24T combination tool top support fork prong
24B combination tool bottom support fork prong
26 combination tool knuckle pin holder cup
28 combination tool knuckle pin holder cup bottom
29 combination tool knuckle pin holder cup bottom hole
30A attachment weld for hanging peg
30B attachment weld for bottom of cup
30C attachment weld for top of cup
30D attachment weld for cup bottom

DESCRIPTION—FIGS. 1 TO 6

Figure 2:
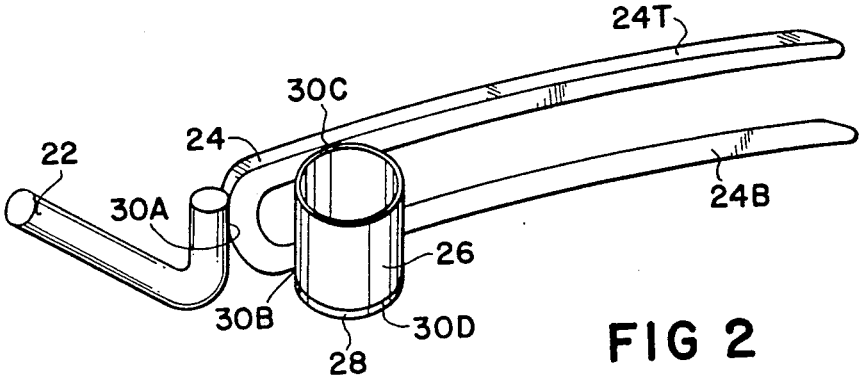
FIG. 2 shows a four part tool attached together by weld, according to the invention.

FIG. 2 shows a combination purpose tool consisting of four parts; attached together by weld, this forms the preferred embodiment of the tool. The composition of material is mild steel.

Figure 3:
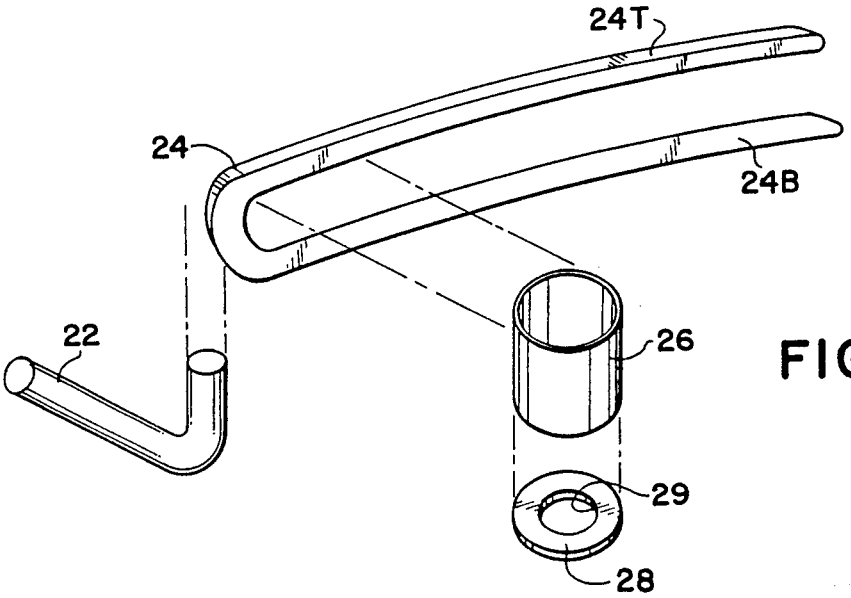
FIG. 3 shows an exploded view of such tool.

The tool comprises a knuckle hanging peg 22 which attaches to a support fork 24. A knuckle pin holder cup 26 that attaches to 24. A knuckle pin holder cup bottom 28 which attaches to 26. The knuckle hanging peg 22 is one piece of seven eighths inch diameter rod, approximately nine and one half inches in length, one and one half inches of 22 attaches by weld 30A to bent end of 24. The remaining length of 22 then bends upward and away from 24, about forty five degrees toward inside curve of 24 FIG. 2. The support fork 24 is one piece of seven eighths diameter rod, approximately thirty one inches long, bent at a one hundred eighty degree angle, half way to form a fork about fifteen inches long with prongs 24T and 24B running parallel, with a one inch space between them FIG. 3. 24 also has a continous curve from end to end, that off sets point of center approximately one inch FIG. 3. 24 also has tips of prongs 24T and 24B beveled substantially on out side edge of their curve, to prevent hanging on application, FIG. 3. The outside edge of 24 around its entirety, has a flat surface FIG. 3 about seven sixteenths inch wide and one sixteenth inch deep to adjust outside dimension to approximately two and five eighths inches. The knuckle pin cup 26 FIG. 3 is comprised of a cylinder, two and three quarters inch long and approximately two inches outside diameter, one and eleven sixteenths inch inside diameter 26 attaches by weld 30B and 30C to inside curve of 24 approximately one inch from 22 FIG. 2. The knuckle pin cup bottom 28 FIG. 3 is a disk one sixteenths inch thick, with outside diameter of one and seven eighths inches. In the center of 28 is a hole 29, three quarters inch in diameter FIG. 3. 28 attaches by weld 30D to end of 26, that is secured to 24B of 24 FIG. 2.

This completes a tool that is approximately twenty inches long and weighs about seven and one quarter pounds.

OPERATION OF INVENTION—FIGS. 1, 4, 5, 6

Figure 4:
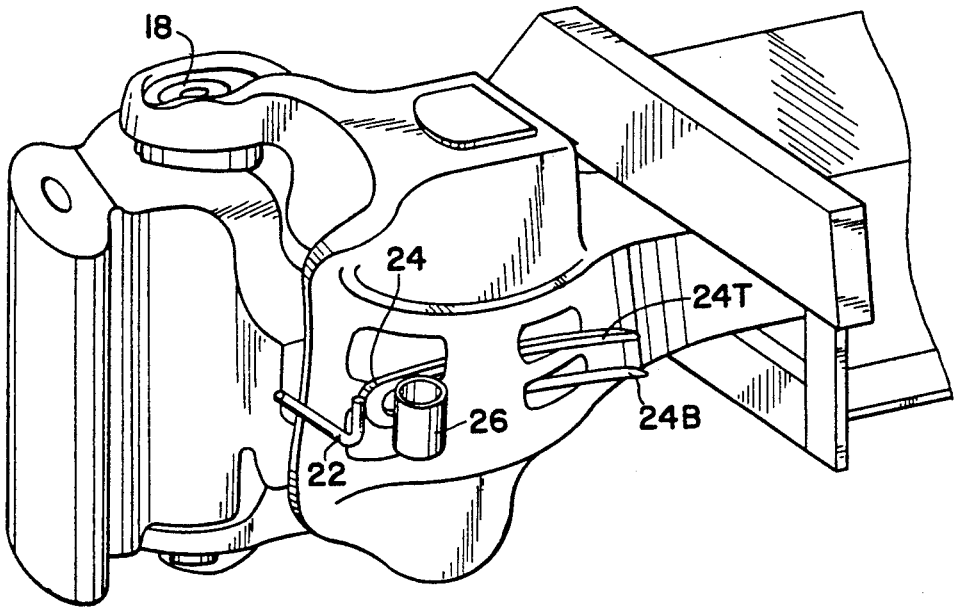
FIG. 4 shows a view of such tool applied and ready for use.

FIG. 1 shows the mechanical device our invention relates to the freight car coupler 14. Utilizing the casting holes 16T and 16B, which go completely through the right side of the coupler body, the combination knuckle hanger and knuckle pin holder forks 24T and 24B slide into these holes. The forks, being curved, follow the contour of the casting holes and emerge on the other side of coupler body FIG. 4. Securing combination tool to the coupler, the tool is now ready for use. This application of tool to coupler can be accomplished with one hand.

Figure 5:
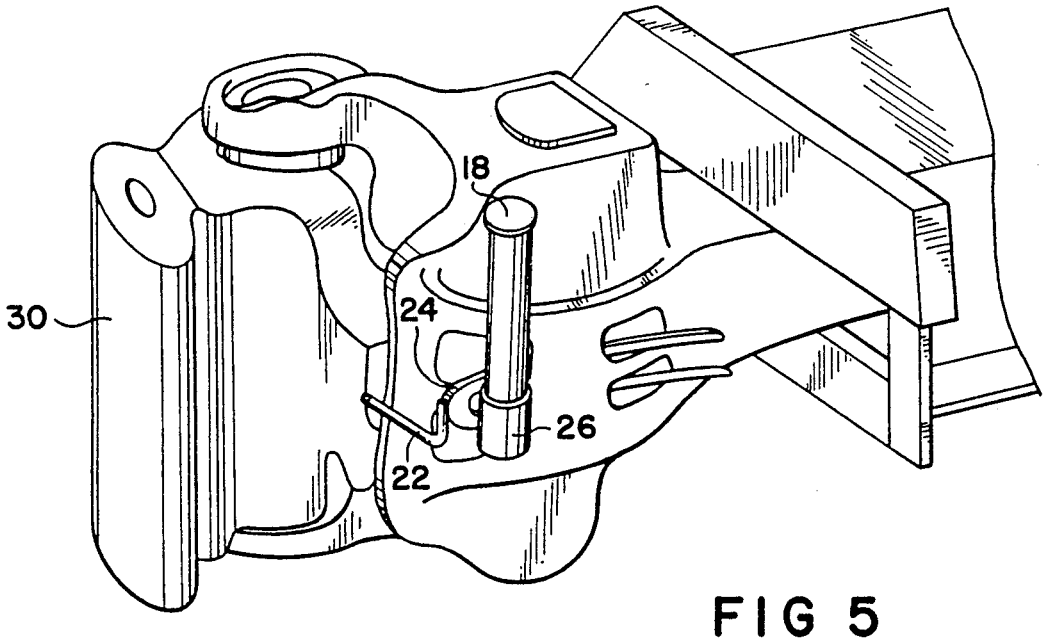
FIG. 5 shows a view of such tool with knuckle pin applied.
Figure 6:
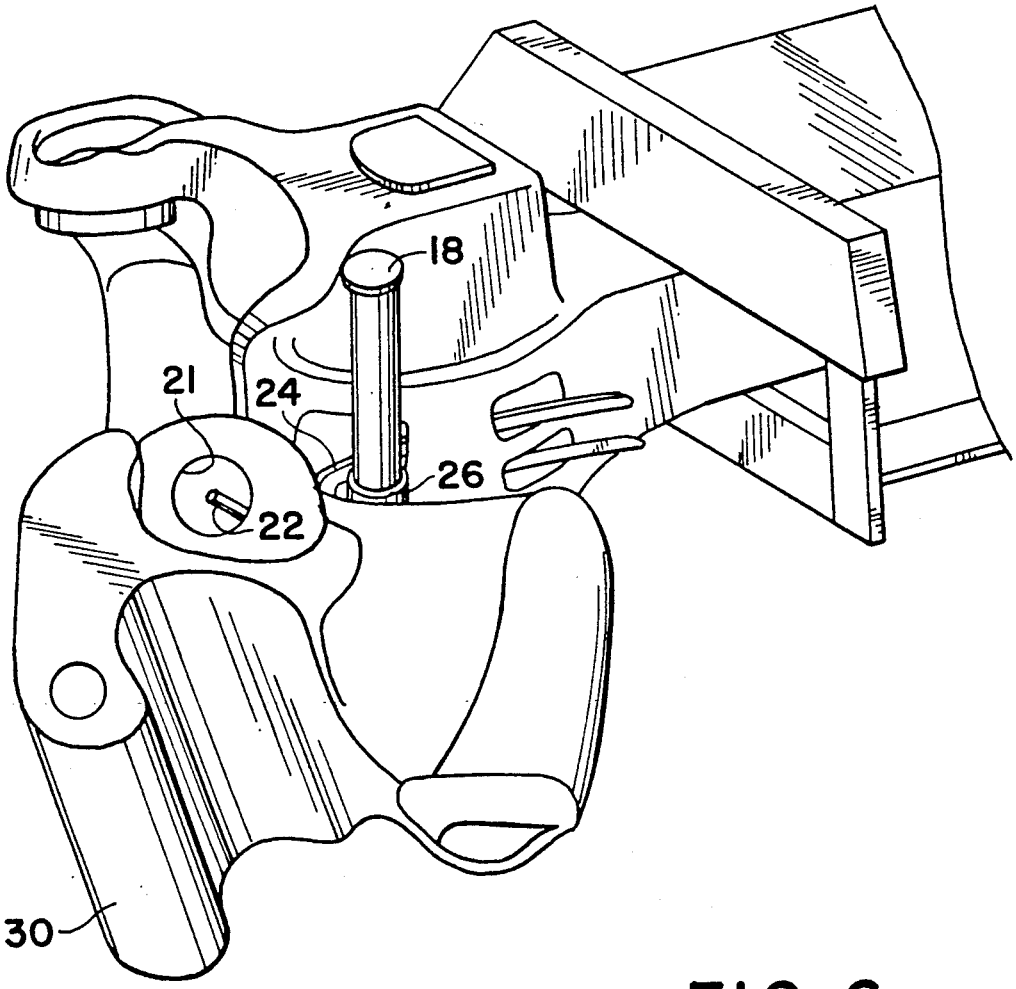
FIG. 6 shows a view of such tool with knuckle pin and knuckle applied.

The knuckle pin 18 which attaches the knuckle 20 to the coupler FIG. 1, is now removed by hand and placed bottom end down into the pin holder cup 26 of the tool, FIG. 5. This frees the knuckle from the coupler. The knuckle may now be removed by hand. Utilizing the knuckle pin hole 21 FIG. 6, the knuckle is now placed onto hanging peg 22 of the tool FIG. 6. The angle of the hanging peg makes this very easy. After the coupler is repaired, the process is reversed. The complete operation is done with very little effort because the eighty three pound knuckle is moved at waist height a very short distance.

SUMMARY, RAMIFICATIONS, AND SCOPE

Accordingly our invention provides a dual purpose tool for safer, faster, and easier repair of a freight car coupler;

provides a tool having no moving parts and being of sturdy construction, that will last indefinitely;

provides the closest place, approximately fourteen inches to put knuckle and knuckle pin when removed from coupler.

provides a tool light to handle, compact, and easily stored

We hope the reader will see the potential of this invention as many hours are lost each year due to injuries incurred performing this particular job.

Even though we may have described definite dimensions in our application, we wish to not be limited but to have flexible specifications. For instance, if manufacturers of couplers were to vary dimensions of their product, we wish to be able to evolve with them. Also the demands of different railroads may vary. Some may want a lighter tool, therefore the composition of metal could be changed to aluminum. Another variation could be in length of the hanging peg to accomodate persons of different height.

So we conclude that the main scope of this invention is not necessarily specific dimensions of embodiment, but rather its novelty and need.

We claim:

1. A knuckle hanger tool for use in suspending a knuckle of a railway coupler on another portion of a coupler during repair of a coupler requiring removal of a knuckle pin and knuckle of a coupler, said tool comprising a fork shaped base section for releasably securing said tool to a coupler, said base section including a pair of generally parallel prong portions for insertion into casting cavities of a coupler, and a generally curved portion integrally connecting said prong portions, and an elongated knuckle hanging peg having opposite ends with one said end being integrally attached to said curved portion, said hanging peg extending outwardly of said base section, where said base section is attachable to dispose another said end in a position for receiving and suspending a knuckle of a coupler thereon during repair of a coupler.

2. The tool of claim 1 further comprising a cup holder integrally attached to said curved portion.

3. The tool of claim 2 wherein said curved portion includes spaced portions integral with respective said prong portions, said cup holder being welded to each said spaced portion of said curved portion.

4. The tool of claim 2 wherein said cup holder is substantially an elongated cylinder with its elongated axis extending generally perpendicular of said parallel prong portions.

5. The tool of claim 2 wherein said cup holder includes a bottom, said bottom having a hole therethrough.

6. The tool of claim 1 wherein said peg extends upwardly from the horizontal generally at 45°.

7. The tool of claim 1 wherein said prong portions are curved between a vertical plane about their free ends and said curved portion so that said prong portions generally medially thereof are offset in another vertical plane.

8. The tool of claim 1 wherein said prong portions include beveled free ends.

9. The tool of claim 1 wherein said other end of said peg is positioned laterally outward of a said prong portions and said curved portion of said base section.

10. A knuckle hanger tool for use in hanging a knuckle of a railway coupler during repair of a coupler, said tool comprising a fork shaped base section for securing said tool to a coupler, said base section including a pair of generally parallel prong portions for insertion into casting holes of a coupler, and a generally curved portion integrally connecting said prong portions and a knuckle hanging peg attached at one end to said curved portion, said knuckle hanging peg having an angled outward end opposite said one end for hanging a knuckle thereupon during coupler repair.

11. The tool of claim 10 further comprising a generally cylindrical holder cup attached adjacent said curved portion for holding a knuckle pin of a coupler.

12. The tool of claim 10 wherein said peg extends upwardly from the horizontal generally at 45°.

13. The tool of claim 10 wherein said prong portions are curved about a vertical plane between their free ends and said curved portion so that said prong portions generally medially thereof are offset in another vertical plane.

14. A combination knuckle hanger and knuckle pin holder tool for use in hanging a knuckle and a knuckle pin of a railway coupler during repair of a coupler, said tool comprising a fork shaped base section for securing said tool to a coupler, said base section including a pair of generally parallel prong portions for insertion into casting holes of a coupler, and generally curved portion integrally connecting said prong portions, a generally cylindrical holder cup attached adjacent said curved portion for holding a knuckle pin of said coupler and an elongated knuckle hanging peg attached at one end to said curved portion adjacent said holder cup, said knuckle hanging peg having an angled outward end opposite said one end for hanging a knuckle of a coupler thereupon.

15. The tool of claim 14 wherein said curved portion includes spaced portions integral with respective said prong portions, said cup holder being welded to each said spaced portion of said curved portion.

16. The tool of claim 14 wherein said cup holder is substantially an elongated cylinder with its elongated axis extending generally perpendicular of said parallel prong portions.

17. The tool of claim 14 wherein said cup holder includes a bottom, said bottom having a hole therethrough.

18. The tool of claim 14 wherein said peg extends upwardly from the horizontal generally at 45°.

19. The tool of claim 14 wherein said prong portions are curved about a vertical plane between their free ends and said curved portion so that said prong portions generally medially thereof are offset in another vertical plane.

* * * * *